US009286760B2

(12) United States Patent
Visser

(10) Patent No.: US 9,286,760 B2
(45) **Date of Patent: *Mar. 15, 2016**

(54) GAMING SYSTEM AND A METHOD OF GAMING

(75) Inventor: Antoon Christiaan Visser, Coogee (AU)

(73) Assignee: ARISTOCRAT TECHNOLOGIES AUSTRALIA PTY LIMITED, North Ryde (AU)

( * ) Notice: Subject to any disclaimer, the term of this patent is extended or adjusted under 35 U.S.C. 154(b) by 227 days.

This patent is subject to a terminal disclaimer.

(21) Appl. No.: 13/618,798

(22) Filed: Sep. 14, 2012

(65) Prior Publication Data

US 2013/0012285 A1 Jan. 10, 2013

Related U.S. Application Data

(63) Continuation of application No. 12/356,158, filed on Jan. 20, 2009, now Pat. No. 8,287,365.

(30) Foreign Application Priority Data

Jan. 21, 2008 (AU) ..... 2008900269
Apr. 9, 2008 (AU) ..... 2008901714

(51) Int. Cl.
*G07F 17/32* (2006.01)

(52) U.S. Cl.
CPC ..... *G07F 17/3258* (2013.01); *G07F 17/32* (2013.01)

(58) Field of Classification Search
None
See application file for complete search history.

(56) References Cited

U.S. PATENT DOCUMENTS

| | | | | |
|---|---|---|---|---|
| 2004/0072613 | A1* | 4/2004 | Visocnik | G07F 17/32 463/25 |
| 2006/0025195 | A1* | 2/2006 | Pennington et al. | 463/16 |
| 2006/0025210 | A1* | 2/2006 | Johnson | G07F 17/32 463/25 |
| 2008/0045288 | A1* | 2/2008 | Moshal et al. | 463/16 |
| 2008/0108430 | A1 | 5/2008 | Evans | |
| 2008/0108431 | A1* | 5/2008 | Cuddy et al. | 463/27 |
| 2008/0113779 | A1 | 5/2008 | Cregan | |
| 2008/0161105 | A1* | 7/2008 | Mishra | 463/27 |
| 2009/0042645 | A1 | 2/2009 | Graham et al. | |
| 2009/0104986 | A1* | 4/2009 | Englman et al. | 463/27 |

(Continued)

FOREIGN PATENT DOCUMENTS

| | | |
|---|---|---|
| AU | 721968 B2 | 6/1998 |
| JP | 11-188171 A † | 7/1999 |
| JP | 2002085738 | 3/2002 |

OTHER PUBLICATIONS

United States Patent and Trademark Office, "Notice of Allowance," issued in connection with U.S. Appl. No. 12/356,158, mailed on Jun. 18, 2012, 14 pages.

(Continued)

*Primary Examiner* — Jason Yen
(74) *Attorney, Agent, or Firm* — Armstrong Teasdale LLP

(57) ABSTRACT

A method of gaming comprises initiating a jackpot event responsive to receiving an event trigger; determining whether to award a prize to a player in the jackpot event, the probability of awarding the prize in the jackpot event being dependent on a value of a jackpot evaluation parameter accumulated over a plurality of games; and awarding the prize in response to making a positive determination.

17 Claims, 7 Drawing Sheets

(56) References Cited

U.S. PATENT DOCUMENTS

| | | | | |
|---|---|---|---|---|
| 2009/0124362 | A1 | 5/2009 | Cuddy et al. | |
| 2009/0124363 | A1 | 5/2009 | Baerlocher et al. | |
| 2009/0191959 | A1 | 7/2009 | Visser | |
| 2010/0016071 | A1 | 1/2010 | Jaffe et al. | |
| 2010/0087256 | A1 * | 4/2010 | Frattinger | G04F 17/32 463/42 |

OTHER PUBLICATIONS

United States Patent and Trademark Office, "Non-Final Office Action," issued in connection with U.S. Appl. No. 12/356,158, mailed on Aug. 19, 2011, 10 pages.

* cited by examiner
† cited by third party

GAMING SYSTEM AND A METHOD OF GAMING

CROSS-REFERENCE TO RELATED APPLICATIONS

The present application claims the benefit of priority to U.S. patent application Ser. No. 12/356,158, filed on Jan. 20, 2009, entitled "A GAMING SYSTEM AND A METHOD OF GAMING," Australian Provisional Patent Application No. 2008900269, filed on Jan. 21, 2008, entitled "A GAMING SYSTEM AND METHOD OF GAMING", and Australian Provisional Patent Application No. 2008901714, filed on Apr. 9, 2008, entitled "A GAMING SYSTEM AND METHOD OF GAMING", each of which is herein incorporated by reference in its entirety.

FIELD OF THE INVENTION

The present invention relates to a gaming system and a method of gaming, and particularly, but not exclusively, to a system and method for awarding a jackpot prize.

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a video display. Win outcomes can occur based on symbols appearing in one or more horizontal lines, diagonal lines, or any other predetermined way.

Gaming systems are known which implement jackpot outcomes. A jackpot outcome may depend on a particular combination of symbols being selected in a base game. Alternatively, a jackpot outcome may depend on a random factor, such as a predetermined amount of turnover. Such a jackpot is termed a "mystery" jackpot, because it is not known to the player when the jackpot will be triggered. In either case, as far as a player of the gaming machine is concerned, the event trigger is invariable. That is, it is either triggered by a predetermined symbol combination, or by an event which the player has no control over.

While such gaming systems and implementations for awarding jackpots provide users with enjoyment, the need exists for alternative gaming systems in order to maintain or increase player enjoyment.

SUMMARY OF THE INVENTION

In accordance with a first aspect, the present invention provides a method of gaming, including:

initiating a jackpot event responsive to receiving an event trigger;

determining whether to award a prize to a player in the jackpot event, the probability of awarding the prize in the jackpot event being dependent on a value of a jackpot evaluation parameter accumulated over a plurality of games; and awarding the prize in response to making a positive determination.

In an embodiment the jackpot evaluation parameter is associated with credits bet/wagered in each of the plurality of games. In an embodiment, the plurality of games are successive games of a base game.

In an embodiment the probability is proportional to the value of credits bet/wagered.

In an embodiment the accumulated value of the jackpot evaluation parameter is associated with a total value or number of special symbols detected in each of the plurality of games. In an embodiment the jackpot evaluation parameter is associated with a total value or number of special symbol combinations detected in each of the plurality of games.

In an embodiment different special symbols have different associated values.

In an embodiment the event trigger is instructed by the player.

In an embodiment the value of the jackpot evaluation parameter is determined when the jackpot event is initiated.

In an embodiment the method includes the further step of displaying a jackpot indicator providing an indication of the value of the jackpot evaluation parameter.

In an embodiment the probability of being awarded the prize is displayed in association with the jackpot indicator.

In an embodiment the prize includes at least one of a primary and secondary prize and wherein there is a random probability for determining which of the at least one primary and secondary prize is awarded.

In accordance with a second aspect the present invention provides a jackpot controller including:

jackpot event module arranged to initiate a jackpot event responsive to detecting an event trigger;

determination module arranged to determine whether to award a prize to a player in the jackpot event, the probability of awarding the prize being dependent on a value of a jackpot evaluation parameter accumulated over a plurality of games; and award module arranged to award the prize in response to a positive determination being made by the determination module.

In an embodiment the jackpot evaluation parameter is associated with credits bet or wagered in each of the plurality of games. In an embodiment, the plurality of games are successive games of a base game.

In an embodiment the probability is proportional to the accumulated value of credits bet/wagered.

In an embodiment the jackpot evaluation parameter is associated with a value or number of special symbols detected in each of the plurality of games. In an embodiment the jackpot evaluation parameter is associated with a total value or number of special symbol combinations detected in each of the plurality of games.

In an embodiment different special symbols or symbol combinations have different associated values.

In an embodiment the event trigger is instructed by the player.

In an embodiment the jackpot controller includes a display module arranged to display a jackpot indicator providing an indication of the value of the jackpot evaluation parameter.

In an embodiment the probability of awarding the prize is displayed in association with the jackpot indicator.

In an embodiment the prize includes at least one of a primary and secondary prize and wherein there is a random probability for determining which of the at least one primary and secondary prize is awarded.

In a third aspect the present invention provides a gaming system, the gaming system including a:

jackpot controller in accordance with the second aspect; and a display module operable to display the awarded prize to the player.

In an embodiment the jackpot evaluation parameter is associated with credits bet or wagered in each of the plurality of games.

In an embodiment the event trigger is instructed by the player.

In an embodiment the prize includes at least one of a primary and secondary prize and wherein there is a random probability for determining which of the at least one primary and secondary prize is awarded.

In an embodiment the gaming system is implemented on a stand alone gaming device.

In accordance with a fourth aspect, the present invention provides computer program code which when executed by a processor implements the above methods.

In accordance with a fifth aspect, the present invention provides a computer readable medium providing a computer program in accordance with the fourth aspect.

BRIEF DESCRIPTION OF THE DRAWINGS

Features and advantages of the present invention will become apparent from the following description of embodiments thereof, by way of example only, with reference to the accompanying drawings, in which.

Figure 1:
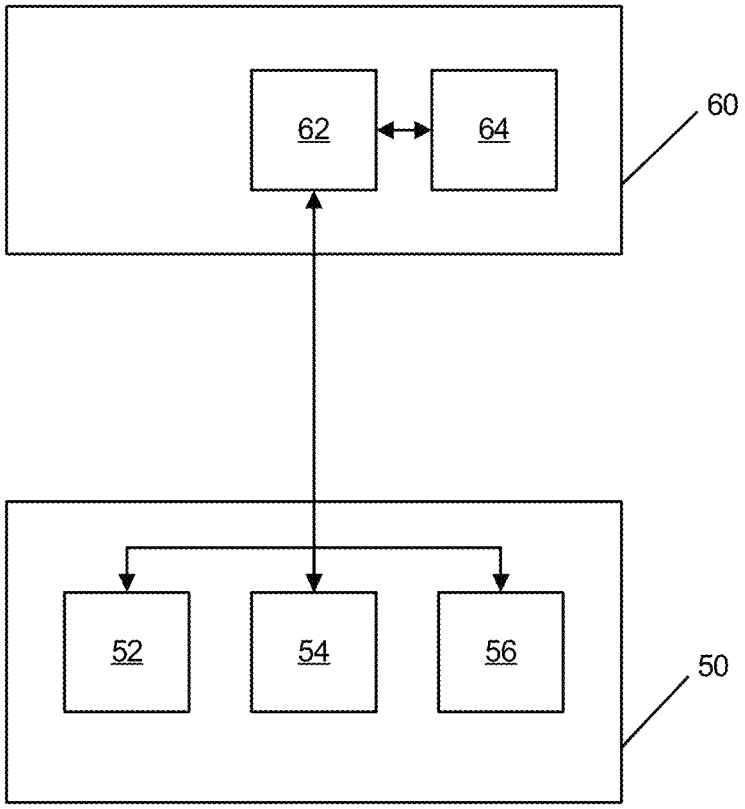
FIG. 1 is a schematic block diagram of core components of a gaming system, according to an embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

In an embodiment a gaming system is provided which includes a jackpot controller arranged to initiate a jackpot event responsive to receiving an event trigger, such as a player instructed trigger. Once a jackpot event is initiated, a determination is made as to whether to award a prize to a player in the jackpot event, whereby the probability of awarding the prize is dependent on a value of a jackpot evaluation parameter accumulated over a plurality of games. For example, the probability of awarding the prize may be dependent on an accumulated value of credits bet or wagered in each of the plurality of games. In response to making a positive determination, a prize is awarded to the player.

General Construction of a Gaming System

The gaming system can take a number of different forms. In a first form, a stand alone gaming machine is provided wherein all or most components for implementing the game are present in a player operable gaming machine.

In a second form, a distributed architecture is provided wherein some of the components for implementing the game are present in a player operable gaming machine and some of the components for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system includes several core components. At the broadest level, the core components are a player interface 50 and a game controller 60 as illustrated in FIG. 1. The player interface is arranged to enable manual interaction between a player and the gaming system and for this purpose includes the input/output components for the player to enter instructions and play the game.

Components of the player interface may vary from embodiment to embodiment but will typically include a credit mechanism 52 to enable a player to input credits and receive payouts, one or more displays 54, a game play mechanism 56 that enables a player to input game play instructions (e.g. to place bets), and one or more speakers 58.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
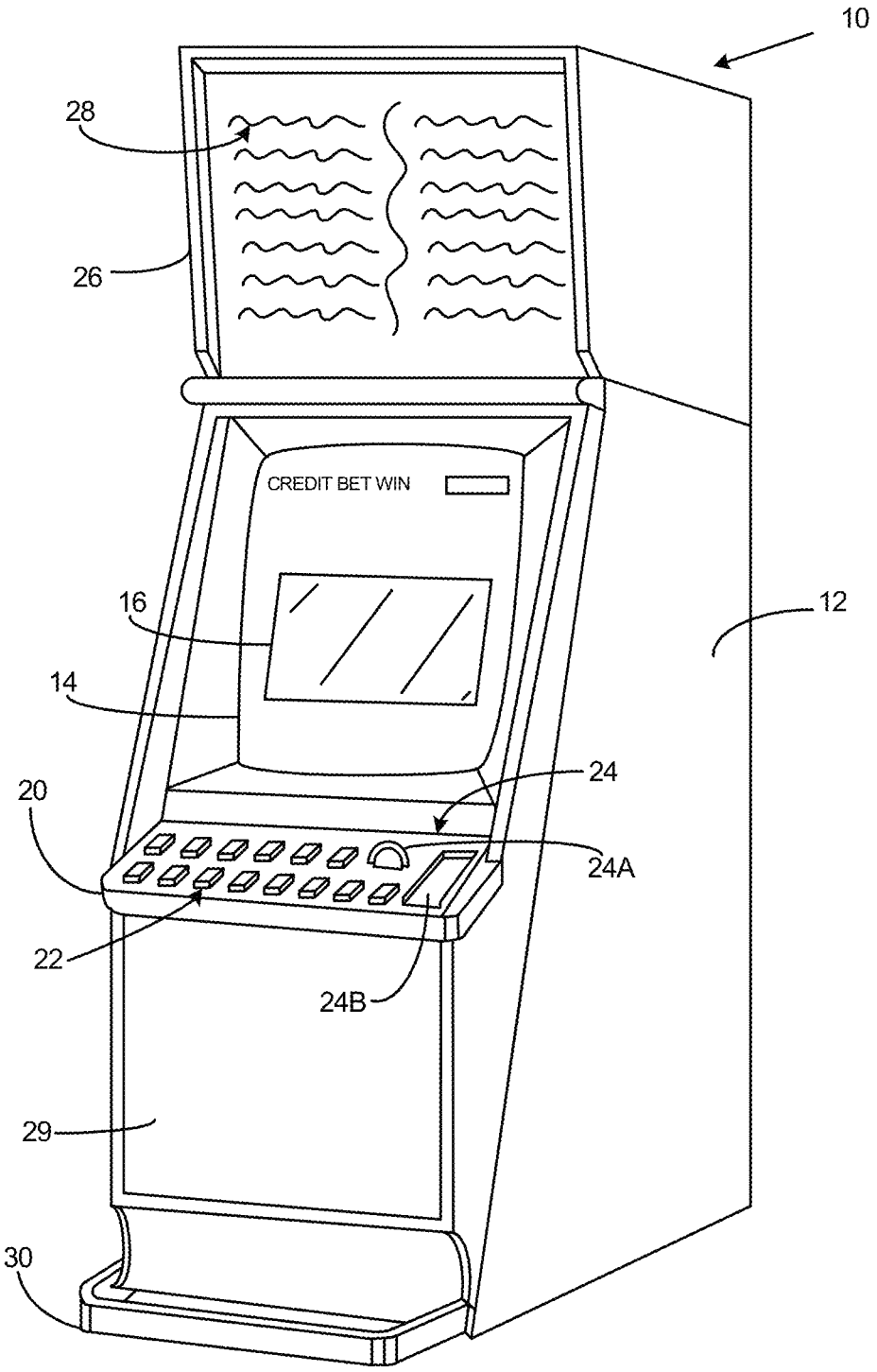
FIG. 2 is a perspective view of a gaming machine arranged to implement the gaming system of FIG. 1, according to an embodiment.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A player marketing module (not shown) having a reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
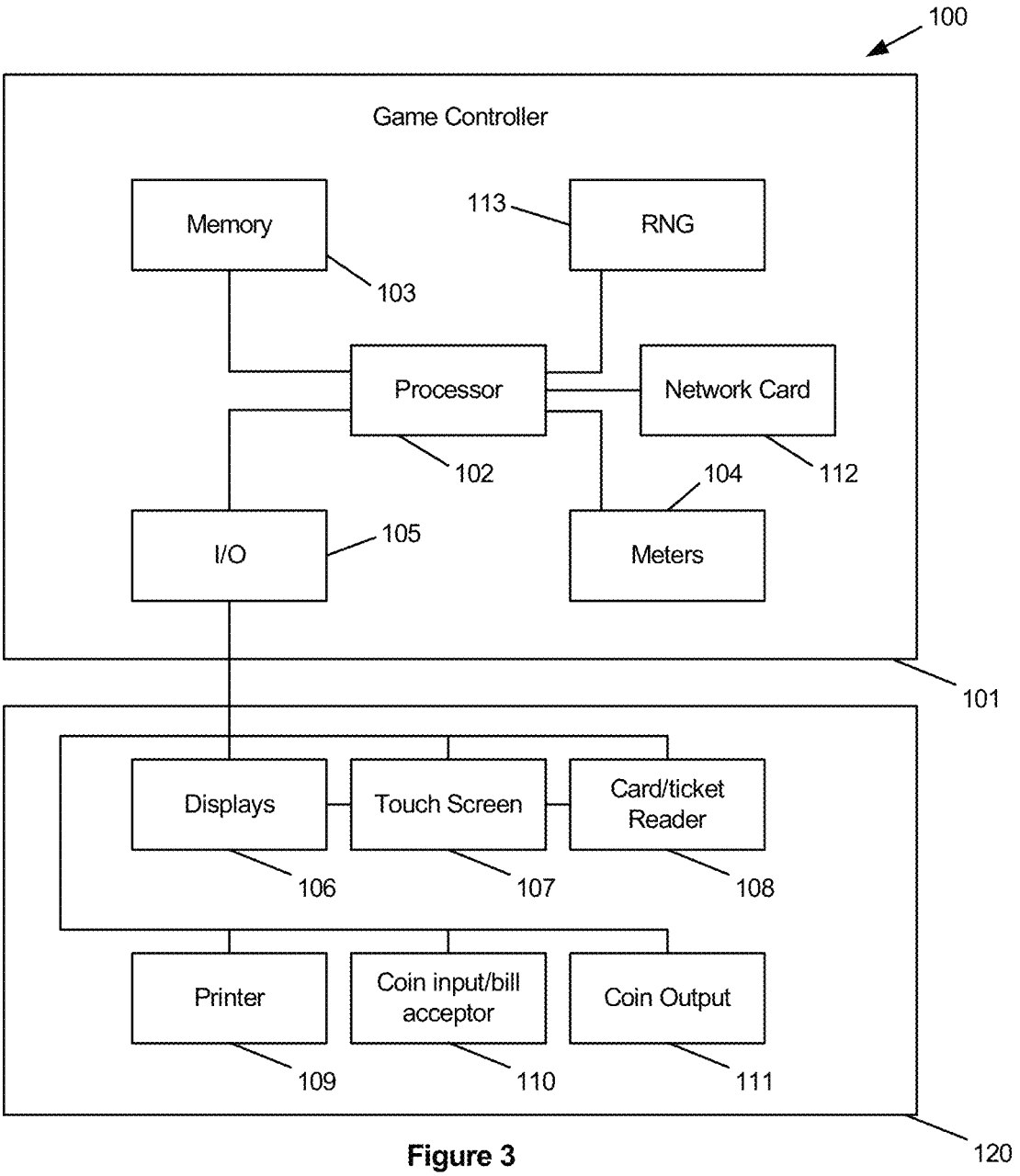
FIG. 3 is a schematic block diagram of operative components of the gaming machine shown in FIG. 2.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 include one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted based on the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
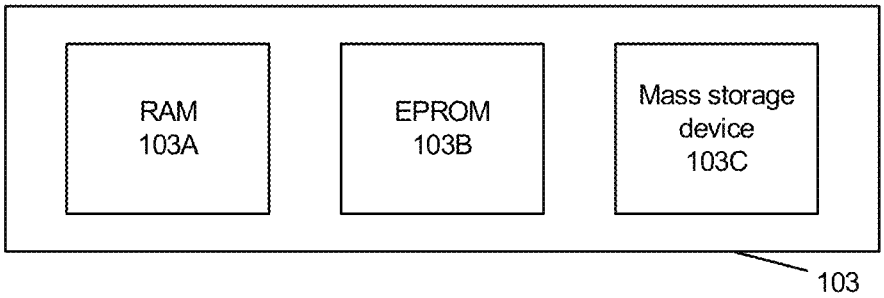
FIG. 4 is a schematic block diagram representing the structure of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
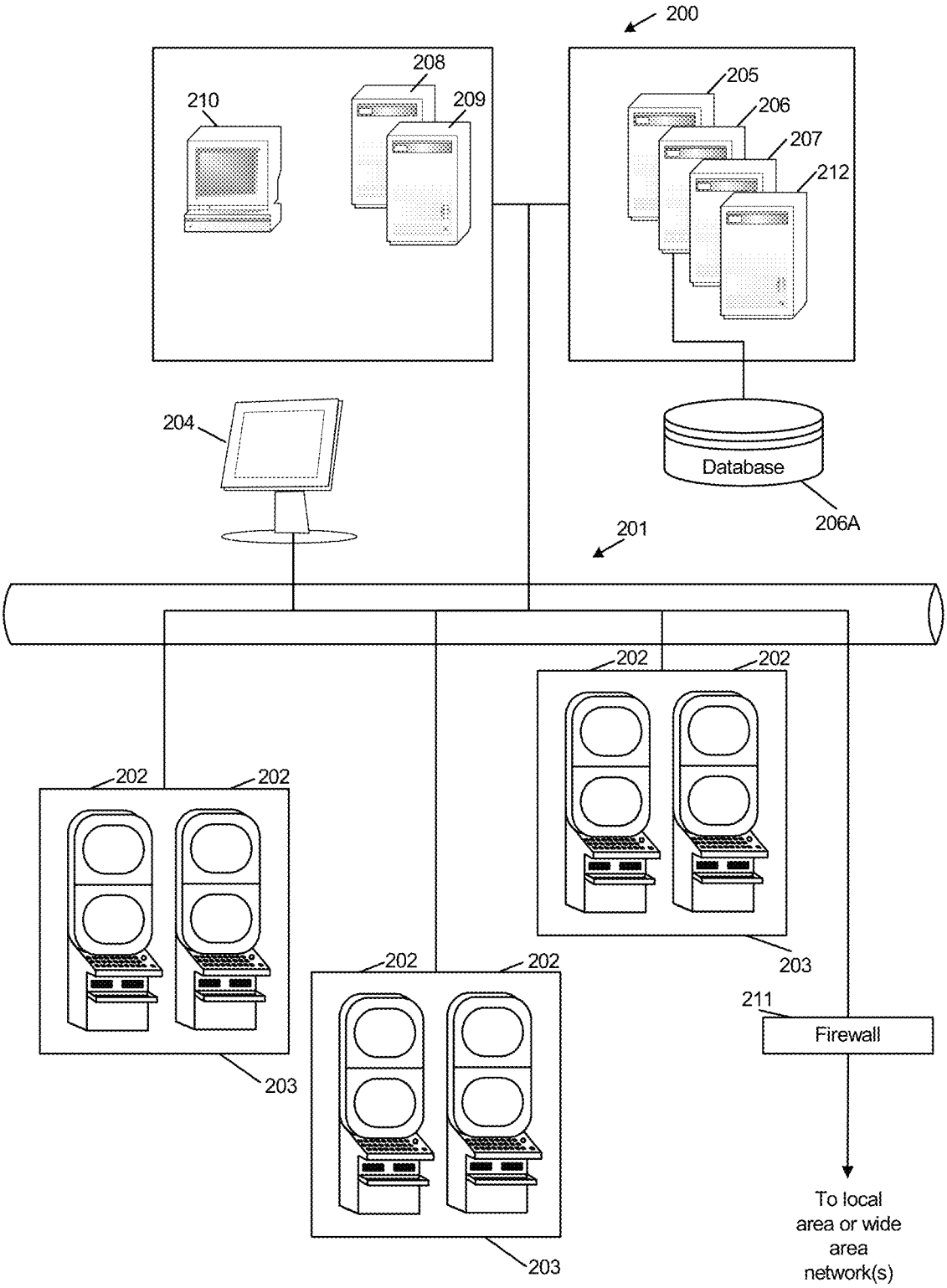
FIG. 5 is a schematic diagram of a networked gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games based on the terminals.

Persons skilled in the art will also appreciate that one or more methods of certain embodiments can be embodied in program code. The program code could be supplied in a number of ways, for example on a computer readable medium, such as a disc or a memory (for example, that could replace part of memory 103) or as a data signal (for example, by downloading it from a server).

Embodiments may be implemented in relation to a spinning reel type game. Gaming systems for implementing games that involve a display of spinning reels as part of the display of the outcome of a game have either a video display or a mechanical display, these later machines most usually being "stepper" machines which have a separate motor for each reel. However, persons skilled in the art will appreciate that the invention can be implemented in respect of other forms of games, including; card games; ball draw games (e.g. bingo or keno); dice games; and pin and ball games.

In some implementations the game controllers of such gaming machines select symbols by employing a stop determining function that randomly determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" visible to the player on the display that which corresponds to a player playing a single win line. When a reel stops, the symbols will be in one of a plurality of possible symbol positions for that reel relative to the stop position.

Spinning reel type games typically allow a player to select how many win lines of a plurality of win lines they will play in each game—i.e. a minimum of one win line up to the maximum number of win lines allowed by the game. Persons, skilled in the art, will appreciate that in other embodiments, the player may select a number of reels to play. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. Some of the win lines will be horizontal or diagonal lines but others may be non-linear combinations of symbols. Typically, the win lines will be constituted by symbol positions in the visible window. A game outcome is determined based on the symbols on the win lines and a prize table that specifies awards.

Figure 6:
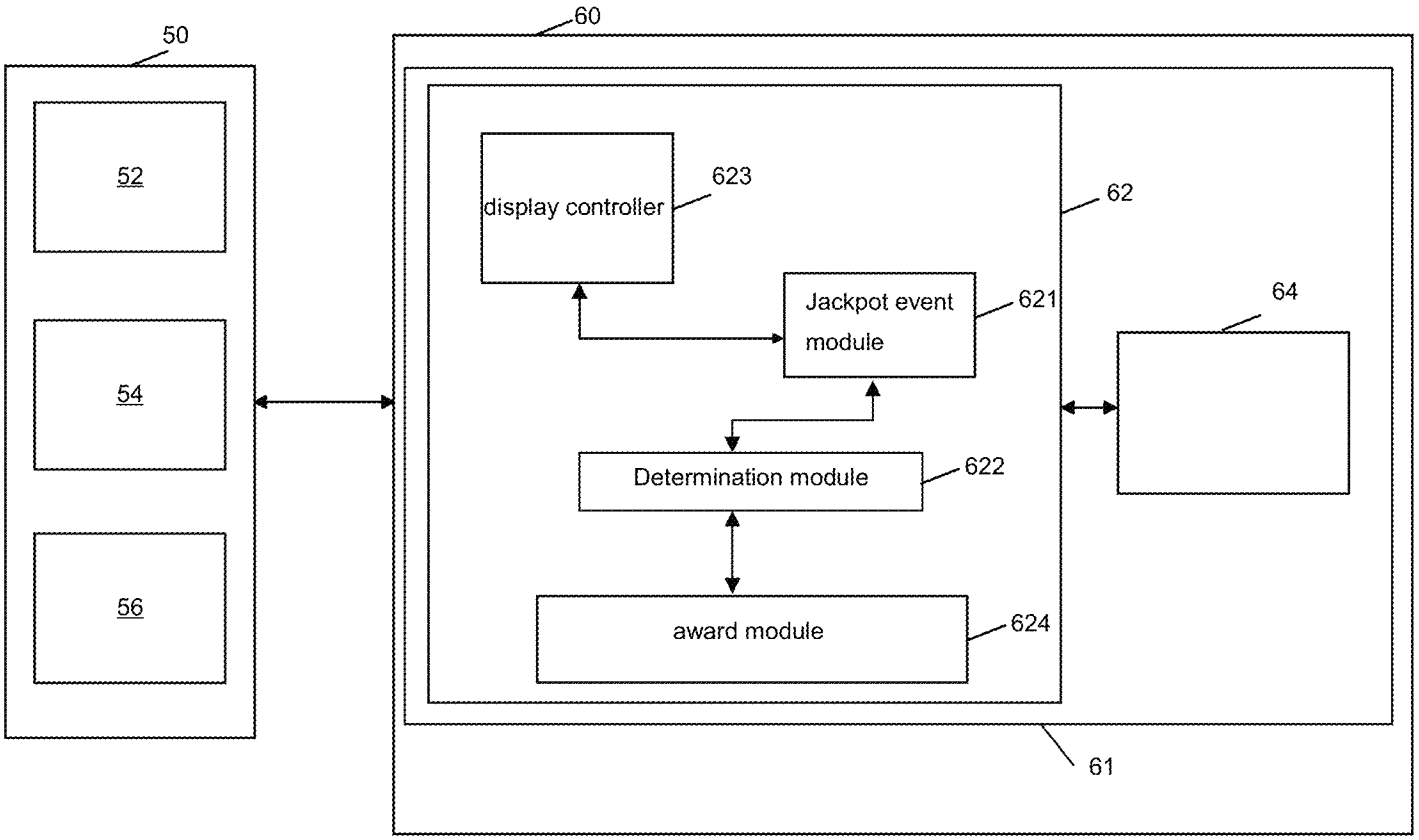
FIG. 6 is a further schematic block diagram of the gaming system.

The game controller 60 of an embodiment is shown in more detail in FIG. 6. For simplicity, only those modules needed to carry out embodiments of the invention are illustrated in FIG. 6. Other standard and/or non-standard modules may also be implemented for carrying out operation of normal and feature game play functionality.

Referring to FIG. 6, the game controller 60 includes a jackpot controller 61 which is arranged to carry out functions associated with initiating jackpot events and awarding prizes therein. Specifically, the processor 62 of the jackpot controller 62 implements a number of modules, namely a jackpot event module 621, determination module 622, award module 624 and display controller module 623 based on data stored in memory 64. Persons skilled in the art will appreciate that not all modules need be implemented by processor 62. For example, the jackpot event module 621 could be implemented by a separate circuit or by a jackpot event module server.

In an embodiment, the jackpot event module 621 is arranged to initiate a jackpot event responsive to detecting an event trigger instructed by a player. The event trigger can be entered by the player using one or more of the buttons 22 located on the console of the gaming machine 10. Preferably, the event trigger is entered before or after play of a base game such that the jackpot event is carried out independently of the base game for increasing player interest. Once the jackpot event is initiated, the determination module 622 determines whether to award a prize to a player in the jackpot event, whereby the probability of awarding the prize is dependent on a value of a jackpot evaluation parameter accumulated over a plurality of games. Responsive to the determination module 622 making a positive determination, the award module 624 awards a prize to the player.

An example of game play according to an embodiment will now be described with reference to the example display screen shot of FIG. 7 and flow chart of FIG. 8.

Figure 7:
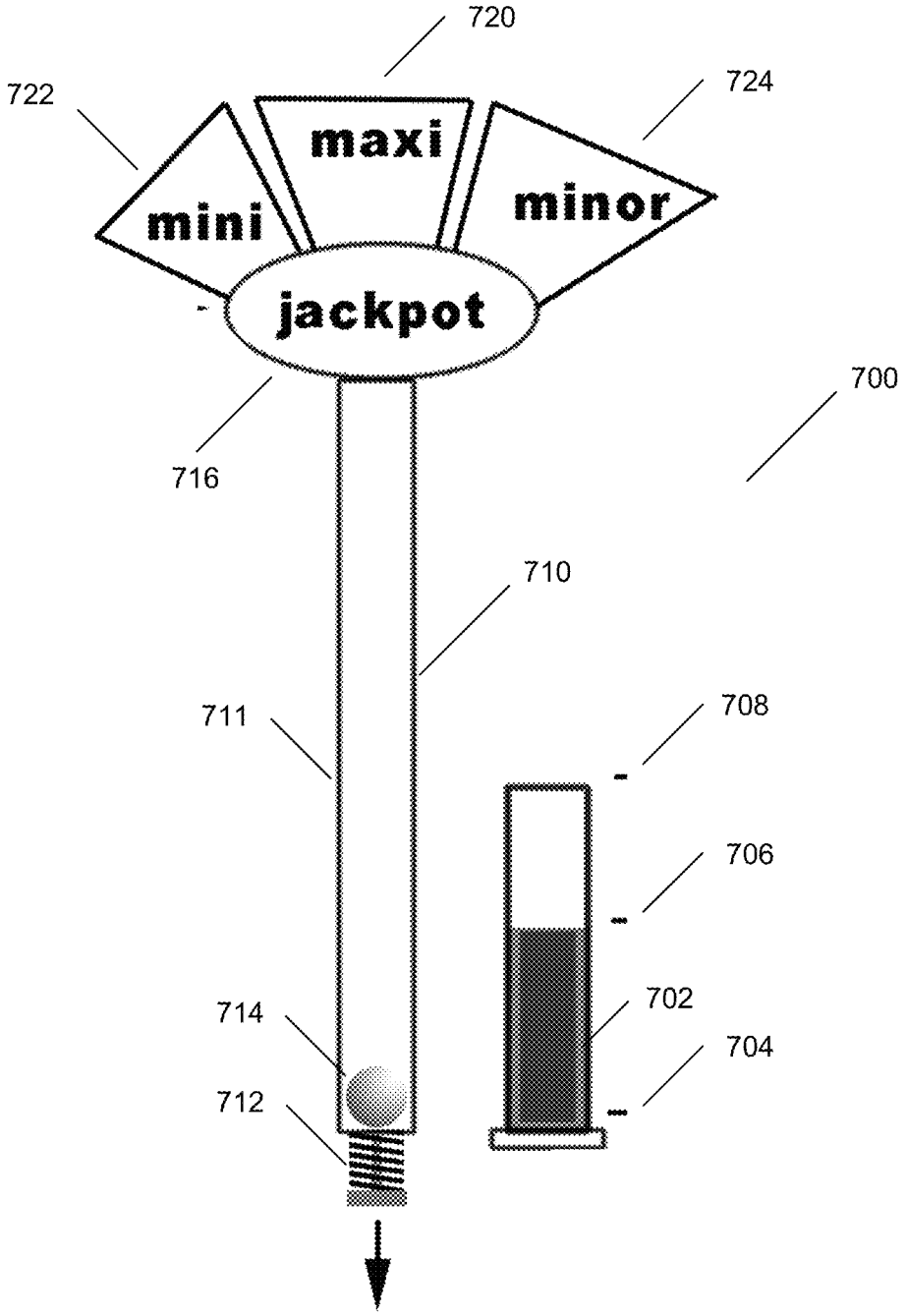
FIG. 7 is a representation of an example jackpot indicator displayed by a gaming system in accordance with an embodiment of the present invention.
Figure 8:
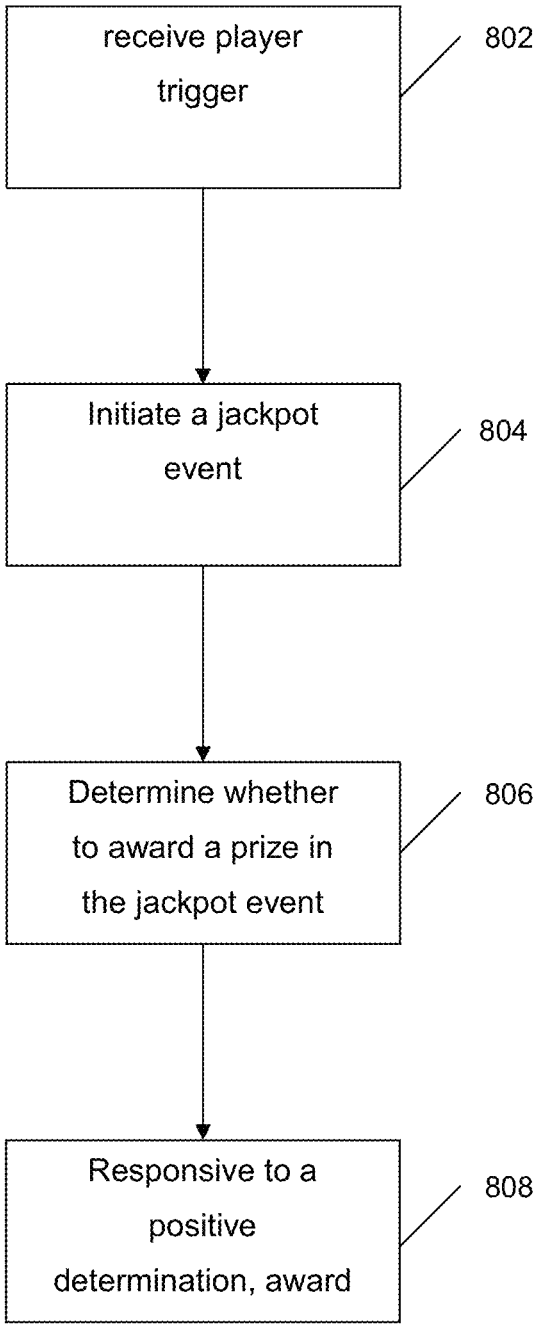
FIG. 8 is a flow diagram illustrating operation of a gaming system in accordance with an embodiment of the present invention.

Referring to FIG. 7, a jackpot indicator 700 is displayed by the display controller module 623. The jackpot indicator 700 is represented in the form of a pressure gauge 702 arranged to provide a player with an indication of a jackpot evaluation parameter. In the embodiment described herein, the jackpot evaluation parameter is the amount of credits wagered/bet in each game of a base game, such as the spinning reel game discussed in preceding paragraphs. In such an embodiment, the value of the jackpot evaluation parameter, upon which the determination is based, is therefore the accumulated value of credits bet in each game up until the jackpot event is triggered. In the illustrated embodiment, the pressure level depicted by the gauge 702 increases after each game by an amount corresponding to the amount of credits bet in that game. For example, in one implementation, if the player bets 100 credits the pressure will increase by 100 increments, whereas if the player bets 10 credits the pressure will only rise by 10 increments. It will be understood, however, that the specific level of the incrementation and association between credits bet and probability may vary depending on the implementation.

As discussed above, the probability of awarding a prize in the jackpot event is dependent on the value of the jackpot evaluation parameter (i.e. in this embodiment, the accumulated value of credits bet in each of the games) when the jackpot event is initiated. In FIG. 7, this probability is displayed in association with the pressure gauge 702 of the jackpot indicator 700. According to this embodiment, three probability level indicators 704, 706, 708 are provided representing a low, medium and high probability of being awarded the prize, respectively. In an embodiment, when the pressure gauge is full (i.e. when the level of pressure has reached the high level indicator 708), the jackpot event module 621 will instruct the player to enter the event trigger. Alternatively, the jackpot event module 621 will automatically trigger the jackpot event.

A strike meter 710 is also displayed by the display controller module 623 for showing the progress and outcome of the jackpot event. The strike meter 710 is in the form of an elongate tube 711 having a ball 712 and striker 714 located at one end of the tube 711 and a jackpot prize area 716 located at the other. Responsive to the jackpot event being initiated, the striker 714 contacts the ball 712 so as to shoot it towards the jackpot prize area 716. If, based on the associated probability, it is determined by the determination module 622 to award a prize, then the ball will be shot through the jackpot tube 711 and then into the jackpot prize area 716, thereby indicating to the player that a prize is to be awarded. If a negative determination is made (i.e. that no prize is to be awarded), the ball does not reach the jackpot prize area 716 and is returned to its start position. In both cases, upon completion of the jackpot event, the pressure within the gauge 702 is re-set to zero. In other words, the accumulated value of the jackpot evaluation parameter is re-set to have a zero value.

In the illustrated embodiment, there are three potential awards that can be awarded to the player, each having a different associated prize value. The primary ("maxi" in FIG. 7) award is denoted by reference numeral 720 and has the highest prize value, whereas the two secondary awards ("mini" and "minor"), denoted by reference numerals 722 and 724, have lesser prize values. According to the illustrated embodiment, there is a random probability as to which of the three potential awards 720, 722, 724 is provided to the player. However, in alternative embodiments, different probabilities may apply depending on the specific implementation. For example, a higher probability for achieving the maxi prize may apply at advertised times, during special bonus periods, etc.

Operation of the illustrated embodiment will now be described with additional reference to the flow diagram of FIG. 8. At step 802 the jackpot event module 621 receives an event trigger for triggering a jackpot event. Responsive to detecting the event trigger, at step 804, the jackpot event module 621 initiates the jackpot event. The determination module 622 subsequently determines whether to award a prize to the player (step 806), whereby the determination is dependent on a value of a jackpot evaluation parameter accumulated over a plurality of games. At step 808, responsive to a positive determination, the award module 624 awards the prize.

In an alternative embodiment, the jackpot event is initiated in response to a non-player triggering technique which is based, at least in part, on a value of the jackpot parameter. For example, the jackpot event may trigger automatically when the value reaches a designated value. In another example, the jackpot event may be initiated in response to detecting a particular combination of symbols occurring in a base game, or responsive to a predetermined amount of turnover being detected by the jackpot controller (i.e. a "mystery" jackpot scenario). Further, in a mystery jackpot scenario, the trigger may be received from an external system, such as a jackpot system or the like. Still further, the jackpot evaluation parameter may alternatively be associated with an amount of credits awarded to the player during play of the base game.

In yet another alternative embodiment, the value of the jackpot evaluation parameter may be associated with a number or value of symbols or symbol combinations detected in the plurality of games. For example, the jackpot evaluation parameter may be representative of an accumulated value or number of "special" symbols detected in the plurality of games. In other words, the occurrence of special symbols may cause the value of the jackpot evaluation parameter to either increase or decrease by a specified amount. The special symbols may be any symbol designated by the game controller 60. The amount by which the evaluation parameter increases or decreases for a detected number/value of special symbols may be determined from a look-up table stored in memory 64.

In an embodiment, different special symbols may have different associated values. In another embodiment, the accumulated value of the jackpot evaluation parameter may directly correspond with the number of detected symbols. For example, if five special symbols are detected over the plurality of games, the value of the jackpot evaluation parameter may also be five (which may represent a high probability of being awarded a prize, depending on the actual implementation).

Furthermore, rather than the actual value of the jackpot evaluation parameter being represented as a pressure level, the value could instead be represented by a corresponding number of balls on offer for shooting for the jackpot. For example, the greater the jackpot evaluation parameter the greater the number of balls, and therefore probability, that one of the balls will reach the jackpot prize area 716. The jackpot evaluation parameter could be represented in other ways.

In the previously described embodiments, a player's interest in the game may be heightened by providing the player with an opportunity to be awarded with a jackpot prize having a probability dependent on a value of a jackpot evaluation parameter, such as the accumulated value of credits bet by the player in successive games of a base game. Further, such an arrangement provides a closer link between the player contribution and probability of being awarded with a prize thereby adding to sense of satisfaction felt by the player upon being awarded with a prize.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

It is to be understood that, if any prior art publication is referred to herein, such reference does not constitute an admission that the publication forms a part of the common general knowledge in the art, in Australia or any other country.

In the claims which follow and in the preceding description of the invention, except where the context indicates otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A method of determining whether to pay out a jackpot of a game conducted on a gaming machine, the method comprising:

accepting credit from a user through at least one of a coin acceptor, a bill validator, a ticket reader, and a card reader;

electronically tracking, after a jackpot is awarded on the gaming machine, an amount of money wagered from the accepted credit each time a base game of the gaming machine is played;

determining a jackpot evaluation parameter based on the electronically tracked amount of money, wherein the value of the jackpot evaluation parameter is associated with a value or number of special symbols detected in each of a plurality of games of the base game;

displaying an indicator of a probability of the user winning the jackpot game, based on the determined jackpot evaluation parameter;

initiating the jackpot event responsive to receiving an event trigger from the user via a gaming machine console of the gaming machine;

executing the jackpot game to determine whether to award a prize to the user triggering the jackpot event based on a value of the jackpot evaluation parameter when the event trigger is initiated by the user; and awarding the prize in response to making a positive determination, and not awarding the prize in response to making a negative determination.

2. A method in accordance with claim 1, wherein the jackpot evaluation parameter is associated with credits wagered/bet in each of a plurality of games of the base game.

3. A method in accordance with claim 2, wherein the probability is proportional to a value of credits bet/wagered.

4. A method in accordance with claim 1, wherein different special symbols have different associated values.

5. A method in accordance with claim 1, wherein the value of the jackpot evaluation parameter is determined when the jackpot event is initiated.

6. A method in accordance with claim 1, wherein the probability of being awarded the prize is displayed in association with the jackpot indicator.

7. A method in accordance with claim 1, wherein the prize comprises at least one of a primary and secondary prize and there is a random probability for determining which of the at least one primary and secondary prize is awarded to the user.

8. A method in accordance with claim 1, wherein the displaying the indicator further comprises refreshing the display of the indicator of the probability of the user winning the jackpot game each time the base game is played by the user.

9. A method in accordance with claim 1, wherein the event trigger is entered by the user via one or more buttons of the gaming console of the gaming machine before or after play of the base game, and the jackpot event of the jackpot game is processed independently of the base game of the gaming machine.

10. A method in accordance with claim 1, wherein the awarding or the not awarding further comprises electronically resetting the jackpot evaluation parameter to zero regardless of whether the determination was positive or negative.

11. A jackpot controller of a gaming machine, the jackpot controller comprising:

a processor for use in detecting whether to pay out configured to:

accept credit from a user input through at least one of a coin acceptor, a bill validator, a ticket reader, and a card reader;

electronically track, after a jackpot is awarded on the gaming machine, an amount of money wagered each time a base game of the gaming machine is played;

determine a jackpot evaluation parameter based on the electronically tracked amount of money, wherein the jackpot evaluation parameter is associated with a value or number of special symbols detected in each of a plurality of games of the base game;

display an indicator of a probability of the user winning the jackpot game, based on the determined jackpot evaluation parameter;

a jackpot event module configured to initiate a jackpot event responsive to detecting an event trigger from the user via a gaming machine console of the gaming machine;

a determination module configured to execute the jackpot game to determine whether to award a prize to the user triggering the jackpot event based on a value of the jackpot evaluation parameter when the event trigger is initiated by the user; and an award module configured to award the prize in response to a positive determination being made by the determination module, and not award the prize in response to a negative determination by the determination module.

12. A jackpot controller in accordance with claim 11, wherein the jackpot evaluation parameter is associated with credits bet/wagered in each of a plurality of games of the base game.

13. A jackpot controller in accordance with claim 12, wherein the probability is proportional to a value of accumulated credits bet/wagered.

14. A jackpot controller in accordance with claim 11, wherein different special symbols have different associated values.

15. A gaming system comprising: a jackpot controller in accordance with claim 11; and a display module configured to display the base game, the indicator of the user winning the jackpot game, the jackpot game, and the determined prize of the jackpot game.

16. A gaming system in accordance with claim 15, wherein the gaming system is implemented on a stand alone gaming device.

17. A non-transitory computer readable storage medium including computer program code and processor logic to execute the computer program code, the computer program code, when executed by the processor logic, implements a method of determining whether to pay out a jackpot of a game conducted on a gaming machine, the method comprising:

accepting credit from a user through at least one of a coin acceptor, a bill validator, a ticket reader, and a card reader;

electronically tracking, after a jackpot is awarded on the gaming machine, an amount of money wagered from the accepted credit each time a base game of the gaming machine is played;

determining a jackpot evaluation parameter based on the electronically tracked amount of money, wherein the value of the jackpot evaluation parameter is associated with a value or number of special symbols detected in each of a plurality of games of the base game;

displaying an indicator of a probability of the user winning the jackpot game, based on the determined jackpot evaluation parameter;

initiating a jackpot event responsive to receiving an event trigger from the user via a gaming machine console of the gaming machine;

executing the jackpot game to determine whether to award a prize to the user triggering the jackpot event based on a value of the jackpot evaluation parameter when the event trigger is initiated by the user; and awarding the prize in response to making a positive determination, and not awarding the prize in response to making a negative determination.

* * * * *